United States Patent [19]

Jernberg

[11] Patent Number: 4,738,372

[45] Date of Patent: Apr. 19, 1988

[54] METHOD AND DEVICE FOR CORROSION RELIEF OF A PRESSURE VESSEL

[75] Inventor: Robert H. Jernberg, East Hampton, Conn.

[73] Assignee: Pressure Pak, Inc., East Hampton, Conn.

[21] Appl. No.: 800,282

[22] Filed: Nov. 21, 1985

[51] Int. Cl.[4] ..... B65D 8/00

[52] U.S. Cl. ..... 220/89 A; 220/5 A; 137/68.1

[58] Field of Search ..... 220/89 A, 89 R, 3, DIG. 27, 220/361, 373, 374, 5 A; 137/68.1

[56] References Cited

U.S. PATENT DOCUMENTS 2,380,964 8/1945 Grover ..... 220/89 A
3,292,826 12/1966 Abplanalp ..... 220/89 A X
4,347,942 9/1982 Jernberg ..... 220/89 A
4,416,388 11/1983 Mulawaski ..... 220/89 A
4,513,874 4/1985 Mulawski ..... 220/89 A

*Primary Examiner*—Steven M. Pollard
*Attorney, Agent, or Firm*—Chilton, Alix & Van Kirk

[57] ABSTRACT

The selective corrosion of a pressure vessel is facilitated to reduce the adverse consequences of a corrosion induced vessel wall rupture. A corrosion resistant coating is applied to the pressure vessel except in a region within the bounds of a restrictor located within the vessel. The region may have a reduced wall thickness. An accelerant material may be applied to the region to facilitate corrosion. Any corrosion induced rupture will occur in the region, and the pressure release due to rupture of the vessel wall will be controlled by the restrictor.

18 Claims, 2 Drawing Sheets

METHOD AND DEVICE FOR CORROSION RELIEF OF A PRESSURE VESSEL

BACKGROUND OF THE INVENTION (1) Field of the Invention

The present invention relates generally to methods and devices for safely relieving excess pressures from high pressure vessels such as compressed gas cylinders. More particularly, the present invention is directed to a method and device for preventing the dangerous pressure release effects resulting from corrosion of a pressure vessel.

(2) Description of the Prior Art

A paramount concern in the use of compressed gas cylinders is the ever-present potential for rupturing of the pressure vessel wall resulting in violent and dangerous release of pressure from the vessel. Two principal physical conditions which cause the rupturing of the vessel wall are excess pressure increase within the vessel and corrosion of the vessel. The excess pressure and corrosion conditions may occur simultaneously and combine to present an unexpected and dangerous result.

A number of devices are available for venting excess pressure from an over-pressurized vessel in response to an increase of the pressure within the vessel to a pressure level above a safe limit. For example, a commonly employed pressure release device consists of a spring-loaded valve installed within an opening formed in the vessel wall. U.S. Pat. Nos. 2,380,964 and 2,951,614 disclose exemplary pressure relief mechanisms which are welded within an aperture formed in the wall of the vessel to be protected.

U.S. Pat. No. 4,347,942, assigned to the assignee of the present invention, discloses a pressure relief device which is responsive to pressure induced physical changes in the pressure vessel itself. The device is formed by coining the end wall of the vessel. The device of U.S. Pat. No. 4,347,942 is essentially self-regulating because the activation point automatically varies with vessel wall thickness. The continuing expansion of the vessel wall past a critical point causes tearing of the metal within the coined region, thus forming an aperture, and results in the venting of excess pressure from within the pressure vessel. The device of U.S. Pat. No. 4,347,942 also includes a restrictor which limits the discharge rate through the formed vessel wall aperture thereby preventing a violent release of excess pressure and a resultant propulsion of the vessel.

While the previously available relief devices have addressed the problems associated with the excess pressure build-up within the vessel, such devices are generally ineffective in addressing conditions resulting from corrosion induced rupturing of the vessel wall which rupturing may occur at vessel pressures well within safety pressure limits. Conventionally, pressure vessels are coated with paints or other special coatings to inhibit corrosion of the vessel wall. However, the conventional anti-corrosion techniques are not infallable and do not provide safety or pressure control means for dealing with the resulting effects when damaging corrosion of the vessel does occur. The present invention is directed to preventing the dangerous results presented by a corrosively induced rupture of the wall of high pressure vessels.

SUMMARY OF THE INVENTION

Briefly stated, the invention in a preferred form is directed to a method and device which addresses the corrosion problems of pressure vessels by causing the maximum rate of corrosion of the pressure vessel to occur at a specific location and controlling any resulting pressure release should a corrosion induced rupture of the vessel wall occur. A corrosion resistant coating is applied to substantially the entire pressure vessel excepting for the region of the pressure relief device or the region adjacent to the relief device. The latter region may be masked by a self-adhesive material. Additionally, means may be provided for selectively accelerating the corrosion of the vessel in the region of the pressure relief device. Such accelerating means may take the form of affixing a moisture retentive material to the masked region.

For a pressure vessel of the type having an end which is coined with a groove adapted to function as a rupturable valve member, at least a portion of the groove is masked, and a corrosion resistant coating is applied to the vessel surface so that the exterior surfaces of the vessel are substantially covered by the coating except in the masked region. The vessel surface in the latter region remains substantially free of the coating. A moisture retentive material may be affixed to the masked region to accelerate corrosion of the vessel wall in the vicinity of the region.

A principal object of the present invention is to address the dangerous conditions associated with the rupturing of pressure vessel walls due to corrosive effects by facilitating the selective corrosion of the pressure vessel.

An additional object of the present invention is to reduce the adverse consequences of the corrosion induced rupture of a pressure vessel wall by controlling the resultant pressure release from the vessel.

Other objects and advantages of the invention will become apparent from the following detalied specification and the accompanying drawing.

DETAILED DESCRIPTION OF THE INVENTION

With reference to the drawings, wherein like numerals represent like parts throughout the FIGURES, a pressure vessel of conventional design excepting for the modifications hereinafter described is generally designated by the numeral 10. Pressure vessel 10 has a generally cylindrical form with end walls which have a generally convex shape. In the illustrated embodiment pressure vessel 10 is employed for containing or storing fluid, for example a liquified gas, under high pressure. Pressure vessel 10 will typically be formed from low carbon steel by deep drawing two cylindrical halves of equal diameter and then welding the two halves together.

Figure 1:
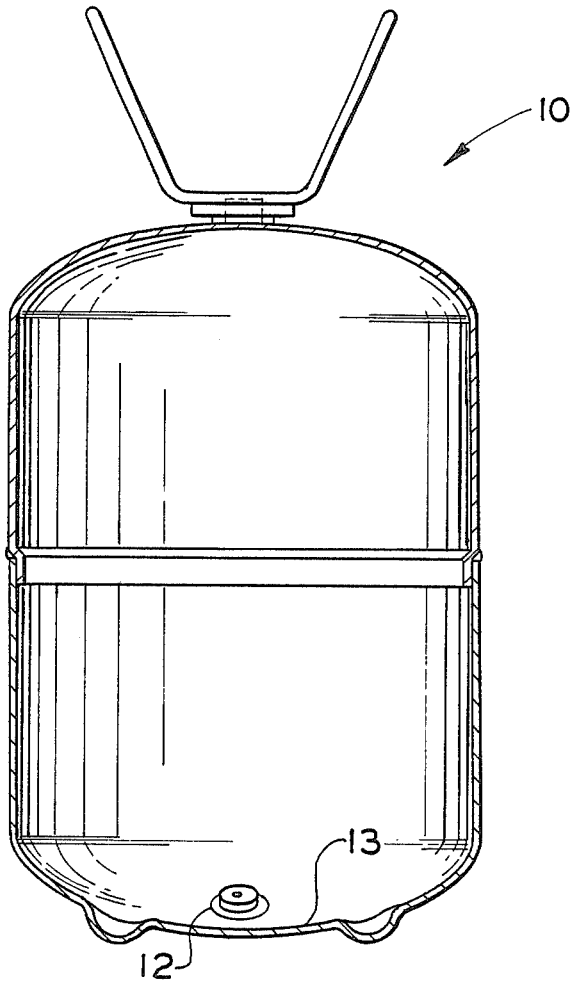
FIG. 1 is a longitudinal sectional view of a conventional pressure vessel illustrating the device and method for corrosion relief of a pressure vessel in accordance with the present invention.
Figure 2:
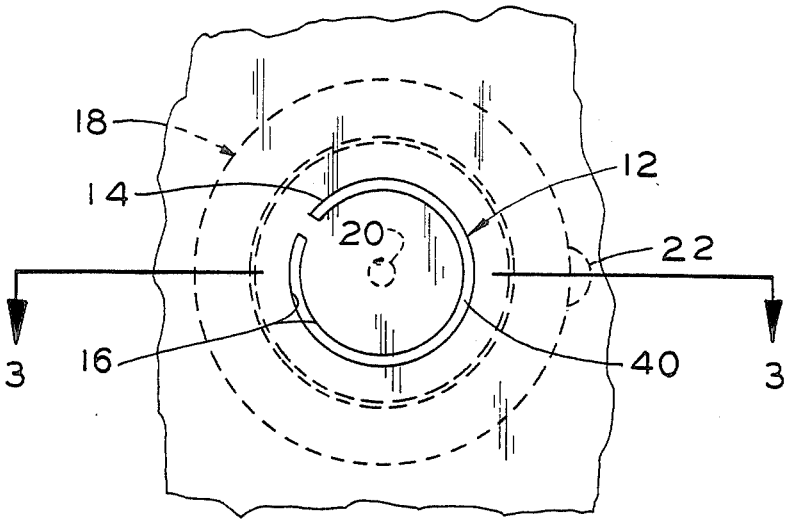
FIG. 2 is an enlarged fragmentary end view of the pressure vessel of FIG. 1, partly in phantom and partly broken away, further illustrating the method and device of the present invention.
Figure 3:
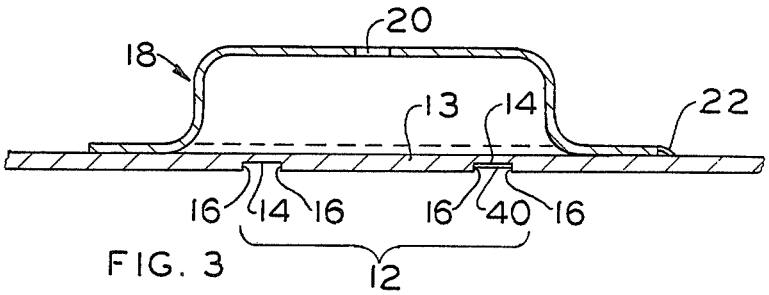
FIG. 3 is an enlarged cross-sectional view of the pressure vessel of FIG. 2 taken along the line 2—2.

With further reference to FIGS. 2 and 3, a pressure relief device 12 is formed or installed in the metal wall of vessel 10. In the disclosed embodiment the relief device is formed by coining an area 14 to form a region wherein the vessel wall 13 has a reduced wall thickness. Relief device 12 is preferably a safety mechanism such as disclosed in U.S. Pat. No. 4,347,942 although, as will be apparent, the invention has applicability to a wide variety of relief devices. The coined area 14 is defined by bottom edges 16. The coined area has side walls which are preferably substantially parallel and includes a substantially flat bottom panel which is preferably transverse to the side walls of the pressure vessel 10. The coined area 14 is preferably a spiral or circular pattern as illustrated but may have a wide variety of shapes.

The coined region functions as an integral rupturable valve member. Accordingly, the wall thickness of the flat area 14 is a function of the thickness of the pressure vessel wall. The ratio of the vessel burst pressure to the relief device activation pressure is critical and, in accordance with the illustrated relief device, the ratio of the thickness of area 14 to the vessel wall thickness is preferably in the range between 45% to 67% of the thickness of the vessel end wall. The illustrated self-regulating safety device has a pressure release point which automatically adjusts the burst point of the vessel as the vessel wall thickness varies due to the expansion pressure of the gas. The corresponding variation in the wall thicknesses may be either deliberately selected or a consequence of the steel varying within the manufacturing tolerances.

A restrictor element 18 is secured within the pressure vessel 10 adjacent area 14. The restrictor element 18 transversely extends so as to encompass the width of device 12. The restrictor element 18 has an aperture 20 which is of a smaller diameter than the inner diameter defined by the coined area 14 of device 12. The restrictor 18 is preferably tack welded at only one point, i.e., is a floating element so as not to impede distortion of the vessel end wall.

Figure 4:
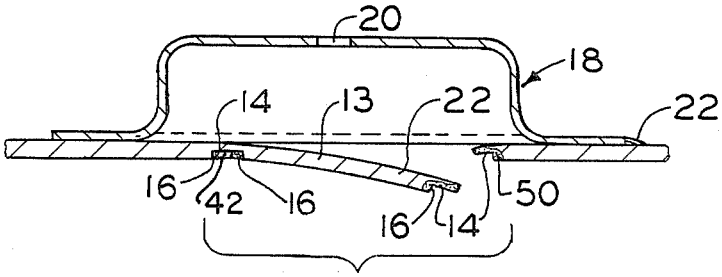
FIG. 4 is an enlarged cross-sectional view of the pressure vessel of FIG. 2 illustrating a resultant corrosion induced rupture of the vessel wall and an alternate embodiment of the invention.

The method of the fabrication of the pressure vessel results in the ends of the vessel being softer than the side walls. Therefore, as will be explained in more detail below, the ends will expand outwardly as a result of over-pressurization of the pressure vessel so that greater stresses are created in the ends. With additional reference to FIG. 4, at a critical point the expanding metal will separate to rupture the end wall 13 thereby forming an opening flap 22 and venting the pressure from within the vessel. By venting the excess pressure from within the vessel 10, the expansion rate of the end walls is reduced and the fracture or rupture of the side of the vessel is prevented. The restrictor element 18 functions to prevent a rapid discharge of the gas from the pressure vessel and thus insures that the vessel will not be propelled into motion when the rupturable pressure relief device opens. Because the pressure vessel has end walls which are preferably either flat or slightly convex, upon over-pressurization the vessel configuration inherently attempts to assume a hemispherical shape. After coining, the material in the area 14 does not have the same ability to elongate as the surrounding material. As the vessel ends distort outwardly pursuant to the tendency to assume the hemispherical shape, the metal tears somewhere within the coined area 14 where the metallurgical structure has been altered during the coining operation. After coining, the material in the area 14 does not have the same ability to elongate as the surrounding material. Thus, the foregoing pressure relief device provides a means for controlling the location of a vessel wall rupture due to over-pressurization and also controllably venting the pressure release through the rupture.

In accordance with the preferred embodiment of the present invention, a mask 40 in the form of a self-adhesive sheet of material having substantially the same shape as coined area 14 is affixed to the coined area 14 so as to substantially cover the area. A corrosion resistant coating such as an air dry enamel is applied to the exterior surface of the pressure vessel except for the masked region of the pressure vessel. The masked region preferably encompasses the entire region of the coined area although only a portion of the coined area need be masked. The masked region of the coined area is thus substantially free of the corrosion resistant coating. Because the masked region is free of the corrosion resistant coating, ordinarily corrosion will first be manifest in the region of the coined area in a manner similar to the corrosion formed regions 50 illustrated in FIG. 4. Thus, any corrosion induced reduction in wall thickness and resultant rupture of the vessel wall will necessarily initially occur in the masked region. Because the masked region is in or at the pressure relief device 12, the corrosion induced rupture of the wall will additionally be controlled by the restrictor element 18 so that the pressure release through the formed rupture will essentially be a controlled pressure release.

It should be appreciated that the masked region need not be entirely coincident with the coined area but may only intersect a portion of the coined area or may in fact be slightly greater than the coined area. By selectively facilitating corrosion at the location of relief device 12, both the situs of the corrosion induced rupture and the nature of the pressure release resulting from the rupture may be selectively controlled.

The masking sheet 40 may be removed after the paint or other corrosion resistant coating is applied to the vessel exterior. The masking material may include a material which retains and/or absorbs moisture. In the latter event, the masking sheet is not removed. In one form of the invention a sponge-like material 42 which accumulates and retains moisture may also be permanently applied in the region of the coined area. Such material 42 functions to accumulate moisture or may contain a corrosion accelerant such as a suitable salt to further controllably accelerate the corrosive action in the area of the relief device 12. It should of course be appreciated that relief device 12 may assume a wide variety of forms in accordance with the present invention. By selectively facilitating the corrosion of the vessel wall at the location of a pressure relief device, the release of the pressure from the vessel may be controlled by the existing pressure relief device thus preventing the propelling of the vessel or other damaging effects resulting from the unexpected rapid release of the gas from the vessel.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A method for reducing the adverse consequences resulting from corrosion of a metallic pressure vessel of a type having an exterior surface and an end portion with an integral area of reduced wall thickness to function as a rupturable valve member comprising:

masking at least a portion of said area to form a masked region; and applying a corrosion-resistant coating to said vessel exterior surface so that said exterior surface is substantially covered by said coating except in said masked region wherein said region remains substantially free of said coating.

2. The method of claim 1 wherein said masked region coincides with said area.

3. The method of claim 2 further comprising the step of:

removing at least part of the masking whereby metal in said area is exposed directly to the ambient atmosphere.

4. The method of claim 3 further comprising the step of:

affixing a material which accelerates corrosion to the exterior of the vessel in at least a portion of the area where the metal is exposed.

5. The method of claim 4 wherein said material comprises a substance for retaining moisture.

6. The method of claim 1 further comprising the step of:

affixing a material to said region to accelerate corrosion of the vessel wall in the vicinity of said area.

7. The method of claim 6 wherein said material comprises a substance for retaining moisture.

8. The method of claim 1 further comprising the step of:

removing at least part of the masking whereby metal in said area is exposed directly to the ambient atmosphere.

9. A method of enhancing the safety of metallic vessels used for the transport of liquified gas comprising the steps of:

facilitating corrosion in a preselected area of the vessel wall whereby any corrosion induced weakness and subsequent rupture will occur in the said area; and controllably venting pressure from the vessel upon occurrence of a wall rupture in said area.

10. The method of claim 9 wherein the step of facilitating corrosion comprises:

exposing the metal comprising the vessel to the environment in at least a portion of said area while protecting substantially the entire remainder of the vessel exterior by application of a corrosion resistant coating thereto.

11. The method of claim 10 further comprising the step of:

affixing a material which accelerates corrosion to the exterior of the vessel in at least a portion of the are where the metal is exposed.

12. The method of claim 11 wherein said material comprises a substance for retaining moisture.

13. The method of claim 10 wherein the step of facilitating corrosion further comprises:

forming a region of reduced wall thickness, said region defining a recess in the vessel exterior wall, said area encompassing said region and said exposed metal.

14. The method of claim 13 further comprising the step of:

affixing a material which promotes corrosion to the exterior of the vessel in at least a portion of the area where the metal is exposed.

15. The method of claim 14 wherein said material comprises a substance for retaining moisture.

16. A pressure vessel comprising:

a pair of generally cylindrical vessel halves, said vessel halves having been formed from low carbon steel by a deep drawing operation and being joined together by welding to define a vessel;

a recessed pattern formed in one end of said vessel to define a region which acts as a rupturable valve member;

restrictor means having an inner wall arranged to surround and enclose the said recessed pattern interiorly of the vessel, said restrictor means having a sized venting aperture in registration with said rupturable valve member region, on excessive corrosion of the cylinder wall said aperture being of a smaller size than the region of the said recessed pattern to prevent too rapid of a discharge from the vessel upon opening of the valve member; and a corrosion resistant coating applied to the exterior surface of said vessel except in a region including at least a portion of the said recessed pattern.

17. The pressure vessel of claim 16 further comprising a moisture retentive substance affixed to said vessel exterior in said uncoated region for accelerating the corrosion of the vessel wall in the vicinity of said pattern.

18. The pressure vessel of claim 16 further comprising a corrosive substance affixed to said vessel exterior in said uncoated region for accelerating the corrosion of the vessel wall in the vicinity of said pattern.

* * * * *

UNITED STATES PATENT AND TRADEMARK OFFICE

CERTIFICATE OF CORRECTION

PATENT NO. : 4,738,372

DATED : April 19, 1988

INVENTOR(S) : Jerrold K. Day

It is certified that error appears in the above-identified patent and that said Letters Patent is hereby corrected as shown below: On The Title Page:

On the front page of the patent, change the "Inventor" entry to read -- Jerrold K. Day, Middle Haddam, Connecticut --.

Signed and Sealed this

Twenty-fifth Day of October, 1988

*Attest:*

DONALD J. QUIGG

*Attesting Officer*

*Commissioner of Patents and Trademarks*